US005742561A

United States Patent [19]

Johnson

[11] Patent Number: 5,742,561

[45] Date of Patent: Apr. 21, 1998

[54] TRANSVERSELY DRIVEN PISTON TRANSDUCER

[75] Inventor: Michael P. Johnson, Shaker Heights, Ohio

[73] Assignee: Northrop Grumman Corporation, Los Angeles, Calif.

[21] Appl. No.: 521,614

[22] Filed: May 10, 1990

[51] Int. Cl.[6] ..... H04R 17/00

[52] U.S. Cl. ..... 367/157; 367/162; 367/167; 367/163; 367/174; 310/334

[58] Field of Search ..... 310/322, 326, 310/328, 334, 337; 367/155, 157, 158, 159, 162, 165, 167, 168, 156, 163, 174

[56] References Cited

U.S. PATENT DOCUMENTS

| | | | |
|---|---|---|---|
| 3,258,738 | 6/1966 | Merchan | 367/159 |
| 3,274,537 | 9/1966 | Toulis | 367/157 |
| 3,277,433 | 10/1966 | Toulis | 367/157 |
| 3,325,780 | 6/1967 | Horan | 367/157 |
| 3,718,897 | 2/1973 | Abbott | 367/157 |
| 4,035,761 | 7/1977 | Ehrlich | 367/158 |
| 4,287,582 | 9/1981 | Tocquet | 367/163 |
| 4,420,826 | 12/1983 | Marshall, Jr. et al. | 367/167 |
| 4,432,080 | 2/1984 | Wardle | 367/163 |
| 4,706,230 | 11/1987 | Inoue et al. | 367/174 |
| 4,845,688 | 7/1989 | Butler | 367/174 |
| 4,858,206 | 8/1989 | McMahon | 367/163 |
| 4,862,429 | 8/1989 | Rolt | 367/165 |
| 4,867,548 | 9/1989 | Butler | 367/155 |
| 4,932,008 | 6/1990 | Rolt | 367/165 |

*Primary Examiner*—J. Woodrow Eldred
*Attorney, Agent, or Firm*—Walter G. Sutcliff

[57] ABSTRACT

A piston transducer having a central longitudinal axis and at least one piston member and an active transducer section displaced from one another along the longitudinal axis. Movement of the active transducer section is generally in a plane perpendicular to the longitudinal axis and a series of lever arms couple the movement of the active transducer section into a corresponding axial movement of the piston member and which axial movement is with a uniform velocity across the radiating surface thereof. For two-sided radiation, another piston member and series of levers may be connected to the active transducer section.

26 Claims, 13 Drawing Sheets

TRANSVERSELY DRIVEN PISTON TRANSDUCER

BACKGROUND OF THE INVENTION

1. Field of the Invention

The invention in general relates to electromechanical transducers, and in particular, to an underwater transducer particularly well adapted for low frequency sonar use.

2. Background Information

Transducers may be used in the underwater environment either singly or in large arrays for the projection and/or reception of acoustic energy in order to accomplish a specific task such as the detection of distant targets or for communication purposes, by way of example.

Various types of transducers have been designed for relatively low frequency use in arrays and all include some sort of active drive section which may be used alone or in conjunction with mass members to accomplish a specific design task.

As will be subsequently discussed, some transducer designs do not lend themselves to use in a large close packed array while other transducers become prohibitively massive for use at lower frequencies.

The piston transducer of the present invention may be of a relatively compact size for use in a close packed acoustic array for high efficiency operation at low frequencies.

SUMMARY OF THE INVENTION

The transducer of the present invention includes at least one piston mass element coupled to the acoustic medium and having a front radiating surface. An electromechanically active driver means exhibiting expansion and contraction in a plane perpendicular to the longitudinal axis of the transducer is provided, with the driver means being spaced from the piston mass along the longitudinal axis. Connecting means couples the driver means with the mass element and is operable to translate movement of the driver means in the plane into a corresponding longitudinal movement of the mass element. The connecting means is constructed and arranged with a series of rigid hinged lever arms each of which experiences uniform angular velocity about the hinge pivot axis such that during the longitudinal movement of the mass element, the radiating surface thereof moves with a uniform velocity distribution with little or insignificant elastic energy storage in the connecting lever arms, thereby resulting in high electromechanical coupling.

In one embodiment, the connecting means includes a plurality of uniformly spaced lever arms connected to a circumferential coupling section surrounding an annular driving means and which includes two piston mass members, one on either side of the annular driving means and spaced along the longitudinal axis.

DETAILED DESCRIPTION OF THE PRIOR ART

Figure 1:
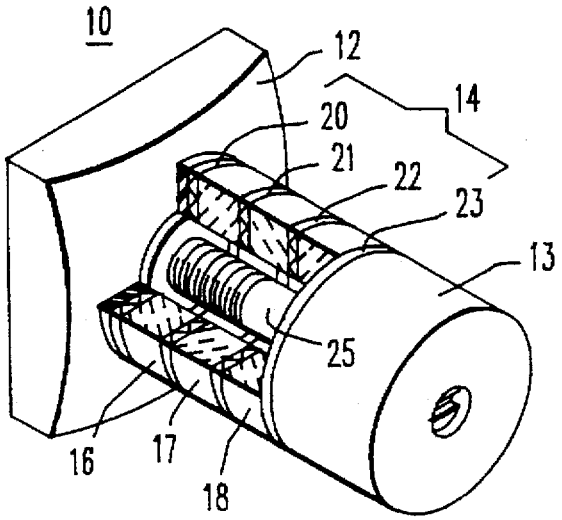
FIG. 1 PRIOR ART
FIG. 1 is a view, with a portion cut away, of a typical longitudinal resonator-type transducer.

Referring now to FIG. 1, there is illustrated a transducer unit of the longitudinal resonator type also known as a "Tonpilz" transducer. The transducer 10 includes a head mass 12 for projection and/or receipt of acoustic energy, a tail mass 13 operative as an inertial element, and a stack of active piezoceramic rings 16, 17 and 18 of a material such as barium titanate or lead zirconate titanate which acts as an active driver section 14 (a portion of which is broken away) interposed between the head and tail mass. Transducer operation is obtained by means of electrical connections (not illustrated) to electrodes 20 to 23. A stress bolt 25 connecting the head mass 12 to the tail mass 13 is provided in order to prevent the active piezoceramic material, which generally has a low tensile strength, from being driven into tension.

Figure 2:
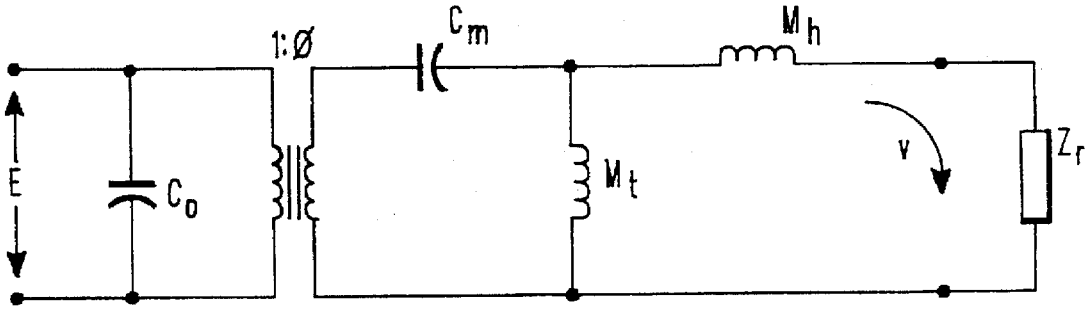
FIG. 2 is the electrical analogy of transducer FIG. 1.

Tonpilz transducers are widely used in high power sonar arrays and the operation of the transducer may be analyzed utilizing conventional electric analog techniques. For example, FIG. 2 represents the electrical analog of the electromechanical transducer and wherein the inductor $M_h$ represents the head mass 12, inductor $M_t$ the tail mass 13, $C_m$ the mechanical compliance of the active piezoceramic material, $C_o$ the blocked electrical capacitance, $\phi$ the electromechanical transformation ratio, and $Z_r$ the acoustical radiation impedance. The current through the radiation impedance $Z_r$ is $v$ and is representative of the fixed velocity distribution of the radiating face of the head mass 12.

The transmitting voltage response TVR which relates the far field sound pressure level to the applied voltage E is proportional to the ratio of velocity $v$ to the applied voltage E and can be calculated from the electrical analog of FIG. 2 in accordance with the following equation:

$$TVR \propto \frac{v}{E} = \phi \left[ \frac{R_r(\omega^2-\omega_r^2) - j\omega M_h(\omega^2-\omega_m^2)}{R_r^2(\omega^2-\omega_r^2)^2 + \omega^2 M_h^2(\omega^2-\omega_m^2)^2} \right] \omega^2 \quad (1)$$

where $\omega_m$ is the angular resonant frequency, $\omega_r$ an anti-resonant frequency due to the tail mass, and $\omega=2\pi f$, where f is the operational frequency. For the case of an array, the radiation impedance $Z_r$ can be replaced, to a good approximation, by the radiation resistance $R_r$.

The Tonpilz transducer is widely used in sonar arrays and can be made with a relatively low quality factor Q for broadband operation at low frequencies. However, as high power sonar system requirements have moved to even lower frequencies, the Tonpilz transducer size becomes prohibitively large and accordingly the array in which it would be used is impractical.

Figure 3:
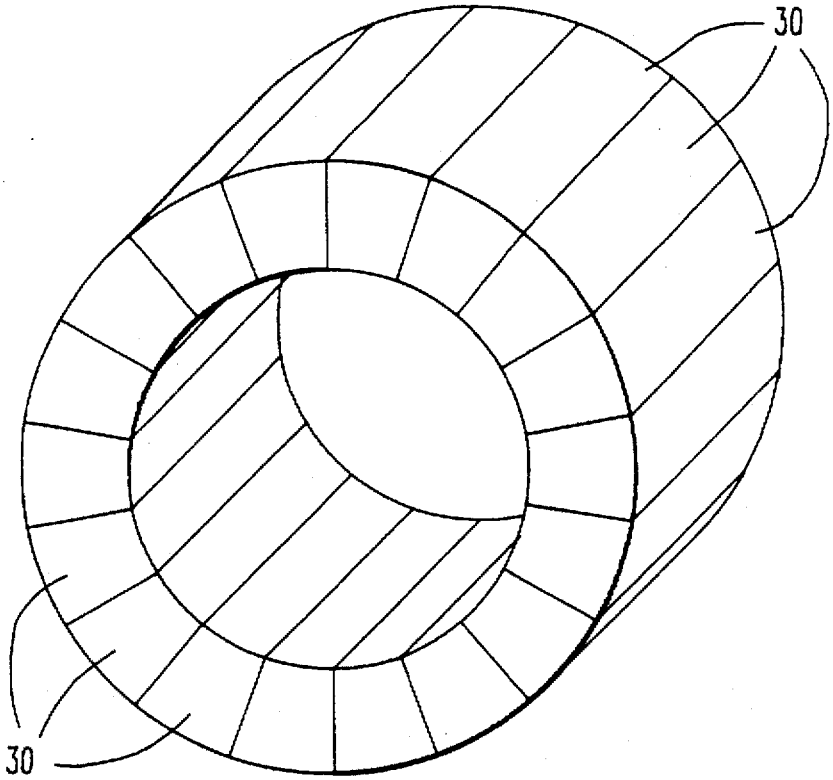
FIG. 3 PRIOR ART
FIG. 3 illustrates a typical ring or cylindrical transducer.

Another type of transducer utilized in the same frequency range as the Tonpilz transducer is the cylindrical or ring transducer, one example of which is illustrated in FIG. 3.

The transducer of FIG. 3 includes a plurality of piezoceramic elements 30 arranged as short staves to form an annular ring. Adjacent touching surfaces of the elements 30 are suitably electroded such that when supplied with the proper electrical energization, the ring will operate in a hoop mode wherein expansion and contraction is primarily in a radial direction.

Figure 4:
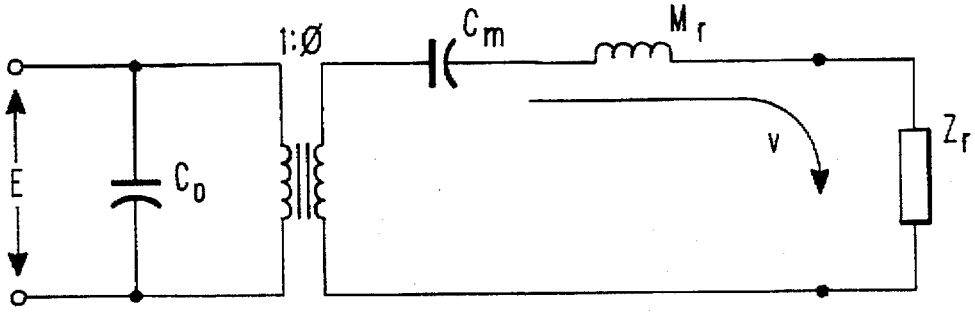
FIG. 4 is the electrical analogy of transducer FIG. 3.

The approximate electrical analog of the transducer of FIG. 3 is illustrated in FIG. 4 wherein the inductor $M_r$ represents the effective mass of the ring transducer, and $C_m$ the mechanical compliance of the active piezoceramic material. The remaining elements are as previously described with respect to FIG. 2. If utilized in an array, the radiation impedance $Z_r$ may be approximated by the radiation resistance $R_r$ and the transmitting voltage response TVR may be determined from Equation 2.

$$TVR \propto \frac{v}{E} = \phi \left[ \frac{R_r\omega^2 - j\omega M_r(\omega^2 - \omega_m^2)}{(R_r)^2\omega^2 + M_r^2(\omega^2 - \omega_m^2)^2} \right] \quad (2)$$

The resonant frequency $\omega_m$ of the transducer is given by the relationship:

$$\omega_m = (C_m M_r)^{-1/2} \quad (3)$$

The acoustical quality factor Q may be determined from the relationship:

$$Q = \frac{\omega_m M_r}{R_r} \quad (4)$$

Although a ring transducer generally is more compact than the Tonpilz transducer for the same frequency of operation, they are still considered to be too large for the lower frequencies and they cannot be packaged efficiently into a two-dimensional array.

Figure 5:
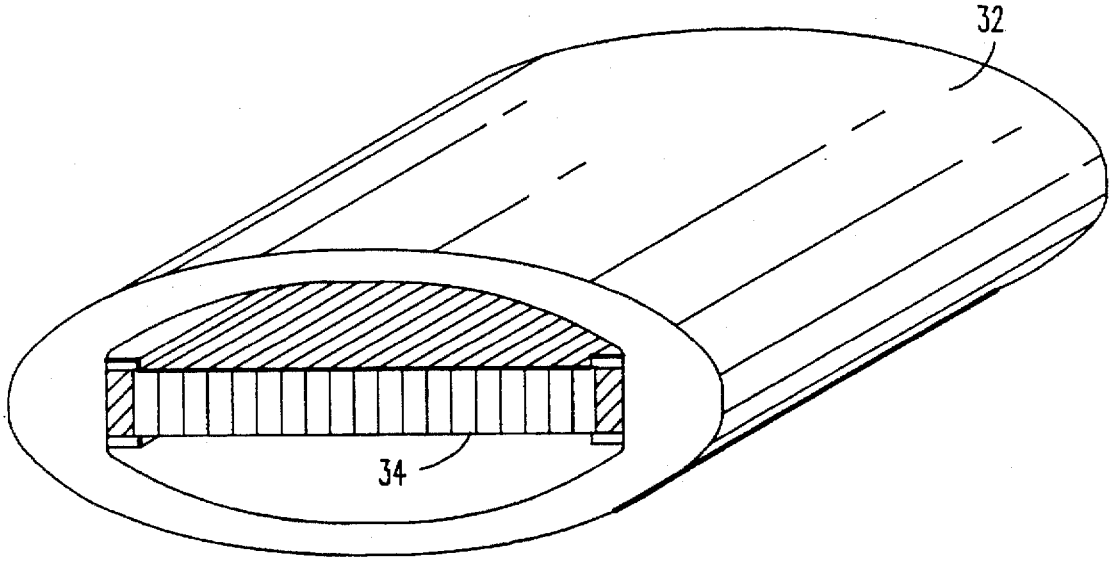
FIG. 5 PRIOR ART
FIG. 5 illustrates one type of flex-tensional transducer.

FIG. 5 illustrates, by way of example, one type of flex-tensional transducer representative of the class of transducers based upon the amplification of acoustic mass reactance as a means of providing an efficient compact low frequency transducer. Basically, the flex-tensional transducer illustrated in FIG. 5 includes an elliptical shell 32 which is driven in a flexural mode of operation using a stack of piezoceramic elements 34 arranged along the major axis of the ellipse. Elongation and contraction of the stack 34 causes the outer shell 32 to flex and thereby project low frequency acoustic energy efficiently from a relatively compact package.

No simple electrical analogy exists for the flex-tensional transducer. One of the difficulties in analyzing such a transducer is that accurate calculation of acoustic radiation patterns and impedances are only possible using extremely complex mathematical solutions. Further, the analysis becomes even more complex when the transducer is used in an array configuration. Further, due to the complex flexural mode of vibration of the radiating surface, the effective electromechanical coupling factor of the transducer is objectionally reduced.

The effective electromechanical coupling coefficient $K_{eff}$ of any transducer is defined in energy terms as follows:

$$K_{eff}^2 = U_{em}^2 / U_m U_e \quad (5)$$

where $U_{em}$ is the coupled electroelastic energy; $U_e$ is the dielectric energy; and $U_m$ is the elastic energy.

The flexural mode of vibration of the shell of the flex-tensional transducer leads to undesired elastic strain energy supplied by the driver being stored in the shell. This increases the value of $U_m$ which consequently decreases the coupling coefficient $K_{eff}$. A decreased coupling coefficient leads to reduced sensitivity, reduced power handling capability and reduced electrical driveability.

DETAILED DESCRIPTION OF THE PREFERRED EMBODIMENTS

With the present invention, a high value of effective electromechanical coupling is maintained in a transducer of relatively compact size operable at low frequencies with a low acoustic quality factor $Q_a$ for broadband operation.

Figure 6:
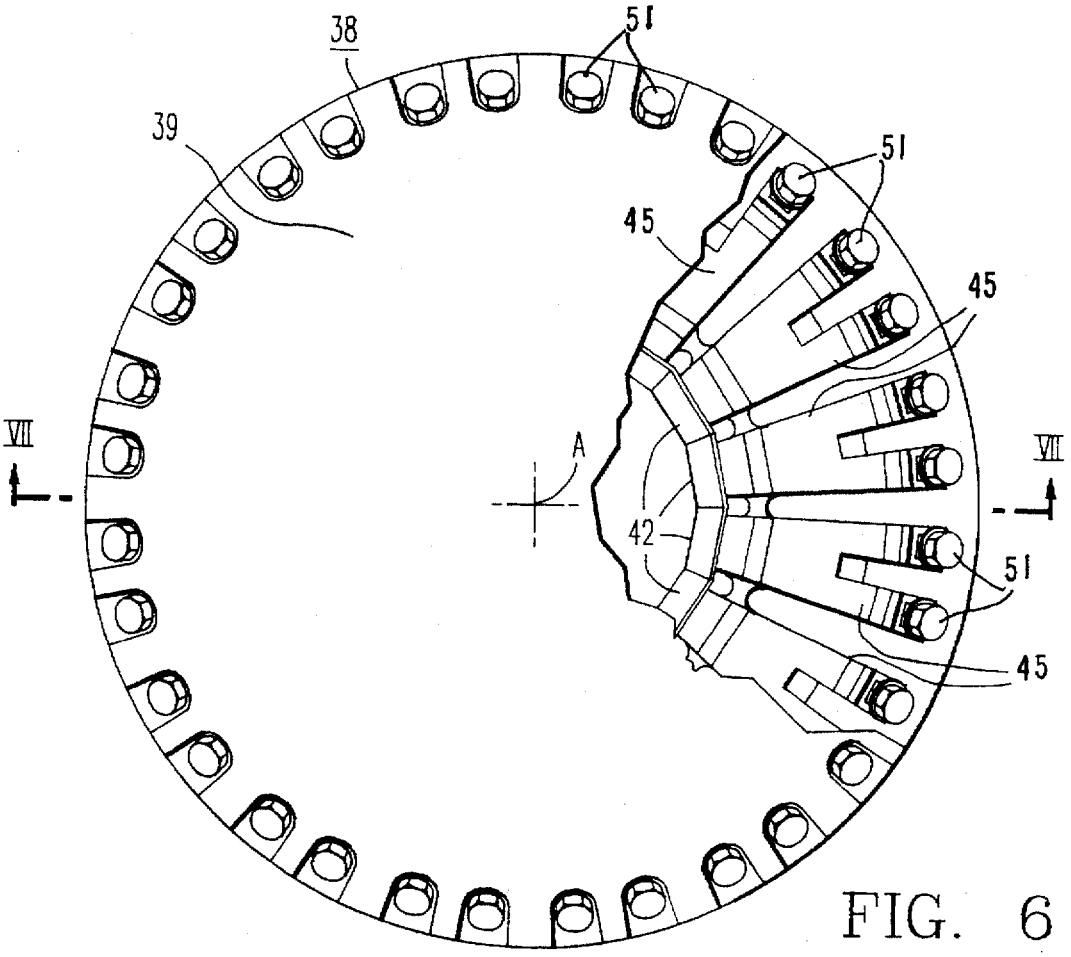
FIG. 6 is a plan view, with a portion broken away, of one embodiment of the present invention.
Figure 7:
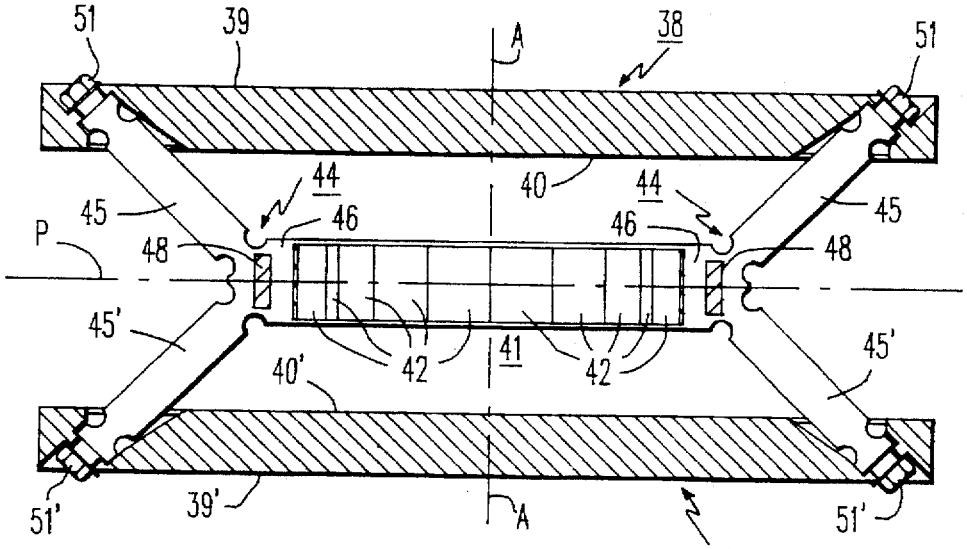
FIG. 7 is a view of the transducer along the line VII—VII of FIG. 6.

One embodiment of the present invention is illustrated in FIGS. 6 and 7, FIG. 6 being a plan view, with a portion broken away, and FIG. 7 being a view along the line VII—VII of FIG. 6. The transducer of the present invention includes at least one piston mass member 38 being symmetrically disposed about a transducer longitudinal axis AA. The piston member 38 includes a radiating front surface 39 and a rear surface 40. An electromechanically active driving means in the form of driver section 41 is spaced from the piston member 38 along the longitudinal axis and is symmetrically disposed thereabout. The driver section 41 may be of the magnetostrictive or piezoceramic variety and is illustrated herein, by way of example, as a piezoceramic driver which in the present embodiment is in the form of a ring. The ring itself may be made up of a plurality of individual piezoceramic elements 42 similar to elements 30 of FIG. 3 and operable in a hoop mode of operation; that is, expansion and contraction of the cylindrical arrangement is in a radial direction.

A connecting arrangement 44 connects the driver section 41 with the piston member 38 and includes a series of rigid lever arms 45 and a coupling section 46 disposed between the driver section 41 and each lever arm 45. The coupling section 46 serves as a concentric circumferential restraining ring which surrounds the ring of piezoceramic elements 42 in order to provide a preloading on them so that they remain in compression during operation. The coupling section 46 has a plurality of sections 48 of reduced volume and cross sectional area such that the stiffness of the restraining ring 46 applying the preloading force is kept to a minimum to prevent significant degrading of electromechanical coupling.

The lever arms 45 are uniformly spaced about the circumference of ring 46 however, for clarity, less than all of the lever arms 45 are illustrated in FIG. 7. As will be brought out, the lever arms 45 in effect are hinged at a first end to the coupling section 46 and hingedly connected at a second end to the piston member 38 and lie at a static angle θo which defines a mechanical transformation ratio. Lever arms 45 are secured to the piston member 38 by means of a series of bolts 51.

In a preferred embodiment, a symmetrical arrangement is provided as illustrated in FIG. 7 wherein symmetrical counterparts of the piston member and lever arms have been given similar respective primed numerals. Thus, for two-sided radiation, the transducer is symmetrical about either side of a central plane P.

Figure 8:
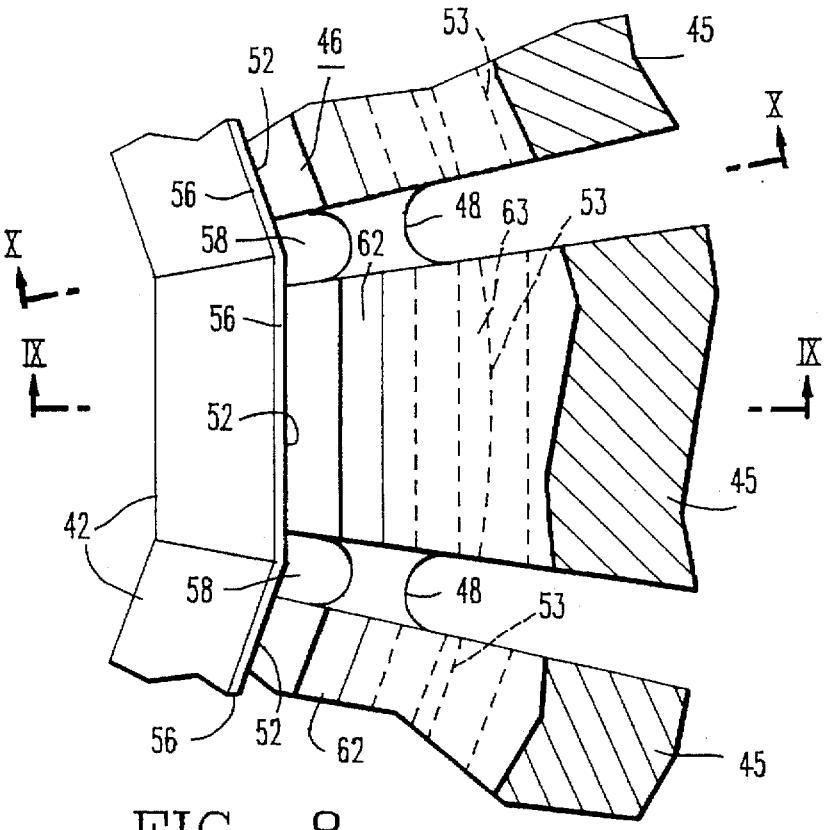
FIG. 8 is a more detailed view of a portion of the transducer of FIG. 6.

FIG. 8 is a plane view of a portion of the assembly previously described in FIG. 6. The coupling section 46 forming a restraining ring may be of aluminum, steel, or metal matrix material, by way of example, and may be of one piece construction which is machined to provide the sections of reduced volume 48 as well as a flat inner surface 52 and a curved outer surface 53.

The preloading force applied by the coupling section 46 is carried by the outer flat surface of each of the piezoceramic elements 42. If the outer surface of the piezoceramic element is not precisely flat, stress concentrations may be set up in the piezoceramic due to the externally-applied preloading force. In order to prevent these stress concentrations, a plastic shim 56 is provided between the outer surface of each piezoceramic element 42 and the flat surface 52 of the coupling section 46. The machining of the reduced volume section 48 results in a groove 58 which also functions to act as a stress relief where adjacent piezoceramic elements 42 and shims 56 abut one another.

Figure 9:
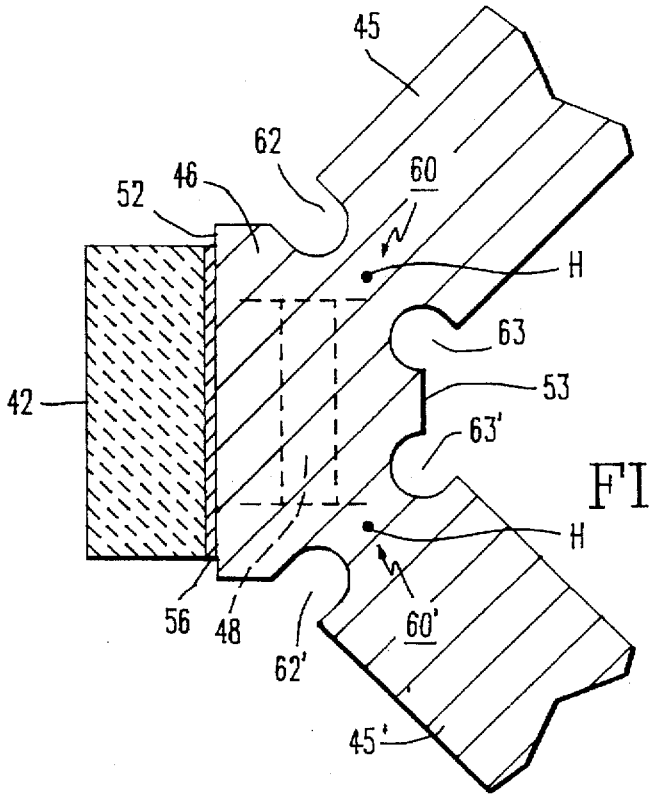
FIGS. 9 and 10 are respective views along lines IX—IX and X—X of FIG. 8.
Figure 10:
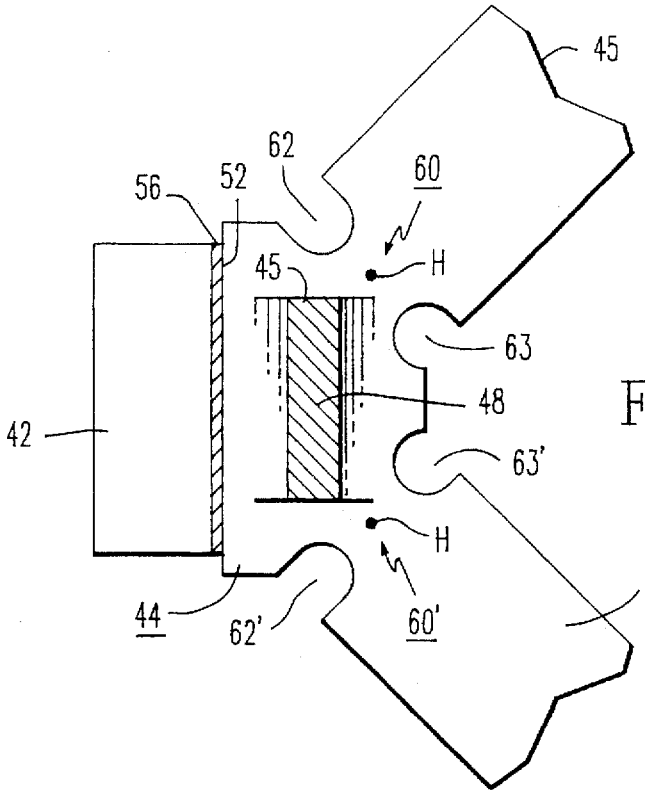

FIGS. 9 and 10 are respective views along lines IX—IX, X—X of FIG. 8 and illustrate the joining of the lever arms 45, 45' with the coupling section 46. In the embodiment illustrated, a first end of each lever arm 45 is integral with the coupling section 46, with the connection defining a first hinge means 60 formed by two grooves 62 and 63. Similarly, lever arm 45' is connected at a first end to coupling section 46 by means of first hinge means 60' defined by grooves 62' and 63'. The hinge means 60 or 60' allows limited angular movement of each lever arm 45 or 45' about a respective hinge axis H and the hinged portion is constructed so as to have a low stiffness when being flexed and a high stiffness when a load is exerted along the lever arm 45 or 45' which themselves are substantially rigid in flexure and transmit the forces from the ring of piezoceramic elements 42 to the respective piston members 38 and 38' on each side of central plane P.

Figure 11:
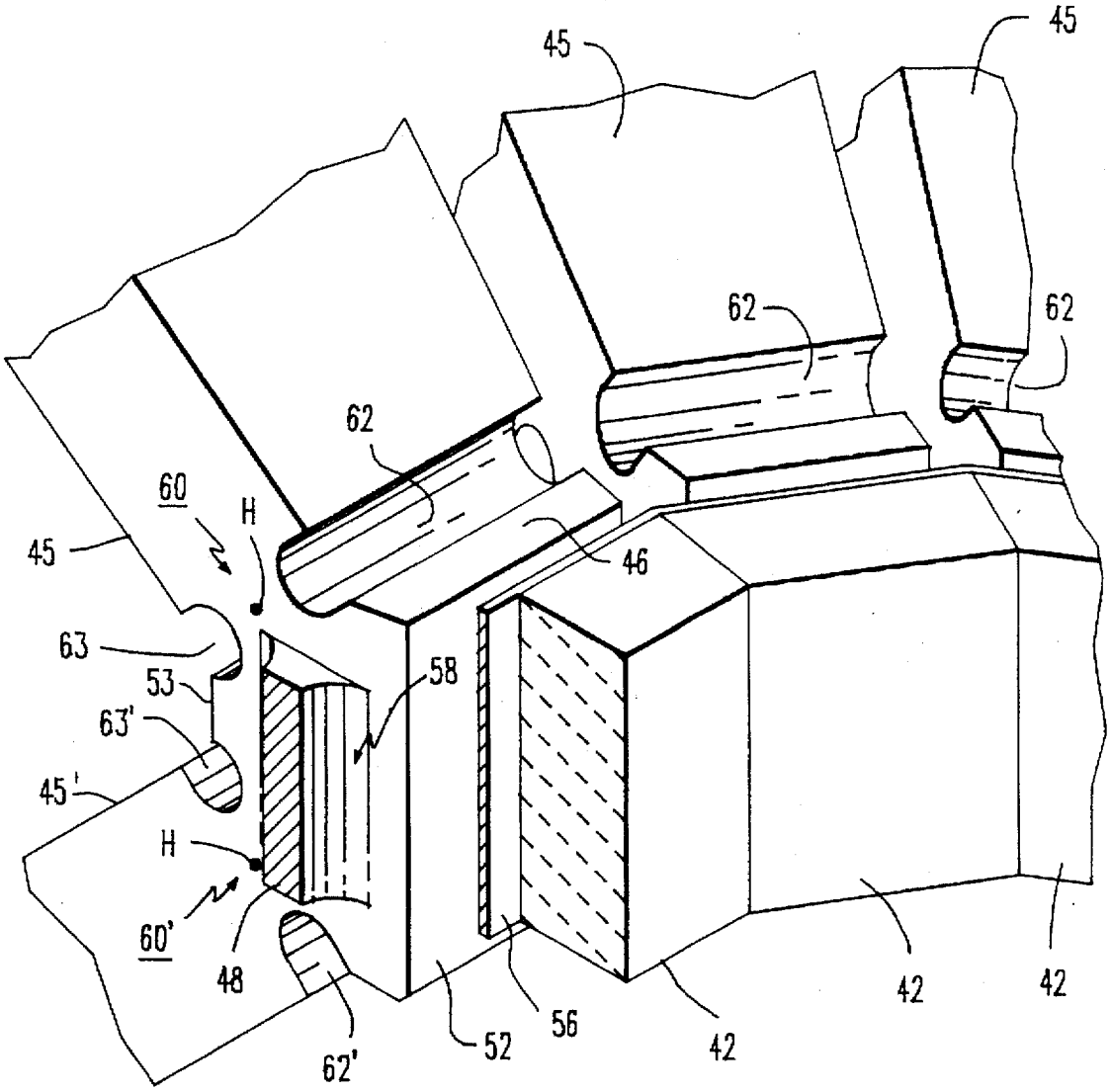
FIG. 11 is another view of the transducer assembly.

FIG. 11 is another view of a portion of the connecting arrangement 44 illustrating the coupling section 46 and several adjacent lever arms 45 as well as other components previously described. The coupling section 46 may be thought of as having a faceted inner surface with the number of facets (flat surfaces 52) matching the number of piezoceramic elements 42. That is, the flat outer surface of each piezoceramic element 42 is contiguous a respective one of the facets, with a shim 56 being interposed between them.

Figure 12:
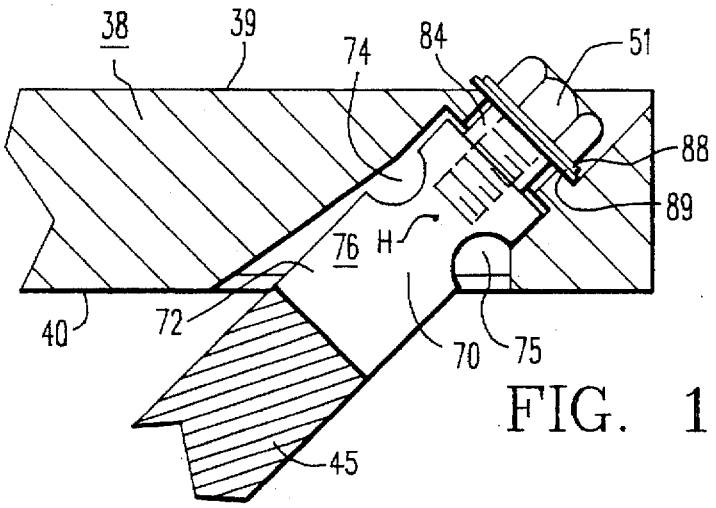
FIGS. 12 and 13 are views illustrating the attachment of a typical lever arm to the piston mass member of the transducer of the present invention.
Figure 13:
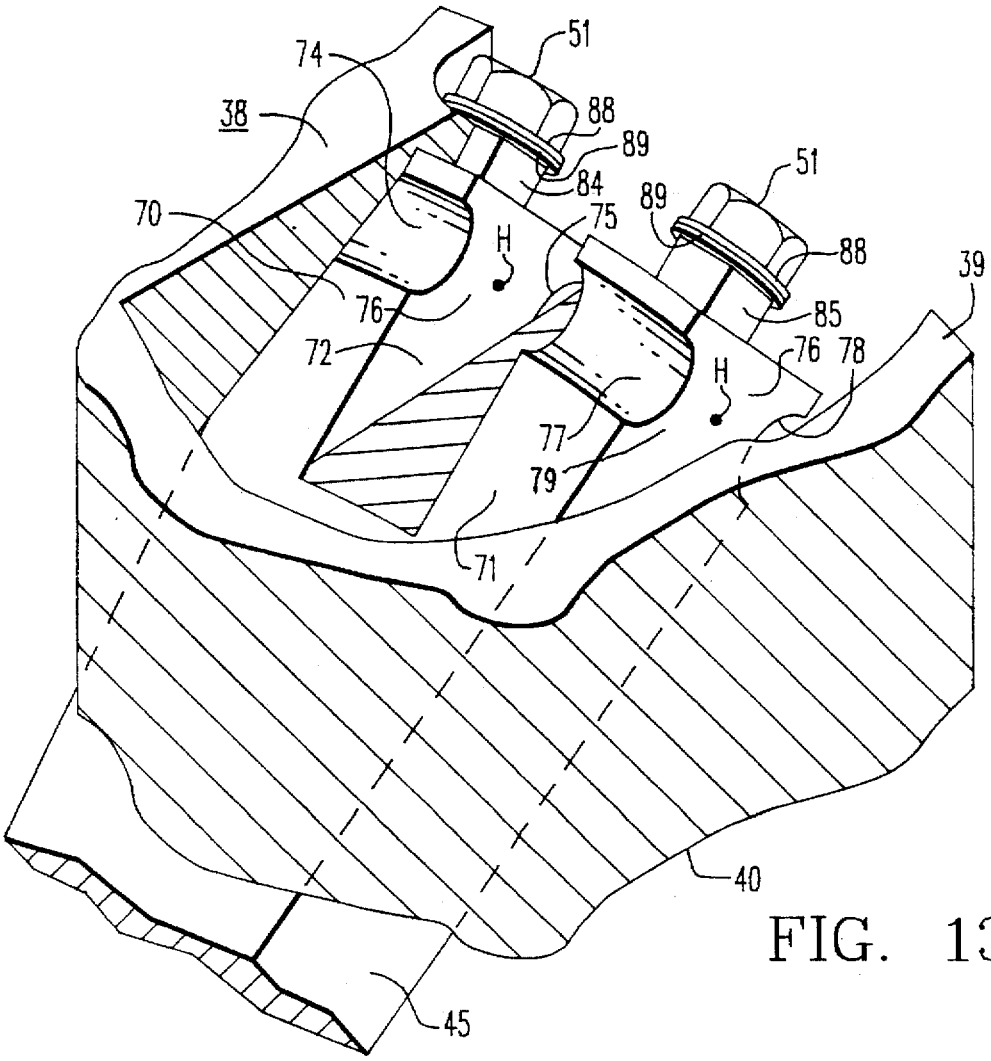

FIGS. 12 and 13 illustrate in somewhat more detail, the connection of a typical lever arm 45 with piston member 38, with FIG. 12 illustrating a cross-sectional view of the connection and FIG. 13 a perspective view. As is best seen in FIG. 13, the upper or second end of lever arm 45 is bifurcated defining two branches 70 and 71 separated by gap 72. Second hinge means are machined into branches 70 and 71 at the second ends thereof by means of grooves 74 and 75 forming hinge portion 76, having a hinge axis H, in branch 70 and grooves 77 and 78 forming hinge portion 79, having a hinge axis H, in branch 71.

Branches 70 and 71 are set into respective separated apertures in piston member 38 such that piston member 38 occupies the gap 72 between branches 70 and 71 in order to help stabilize the edges of piston member 38 against movement exerted by the forces acting along the lever arm 45. A rigid structure and connection is needed in order to prevent any significant bending which will degrade the effective electromechanical coupling coefficient of the transducer and to prevent the points at which the lever arms are mounted to the piston member from moving radially. In order to firmly secure the lever arm 45 to the piston member 38, the branches 70 and 71 include respective guides 84 and 85 internally threaded for reception of a bolt 51. A bellville spring or lock washer 88 and washer 89 keep the assembly in tension and prevent galling of the seat which is machined into the top of the piston member 38 for reception of the bolt 51.

In addition to an electromechanical transformation ratio $\phi$, the transducer of the present invention has a mechanical transformation ratio $\phi_m$ associated with it. An understanding of this mechanical transformation ratio may be obtained with reference to FIG. 14.

Figure 14:
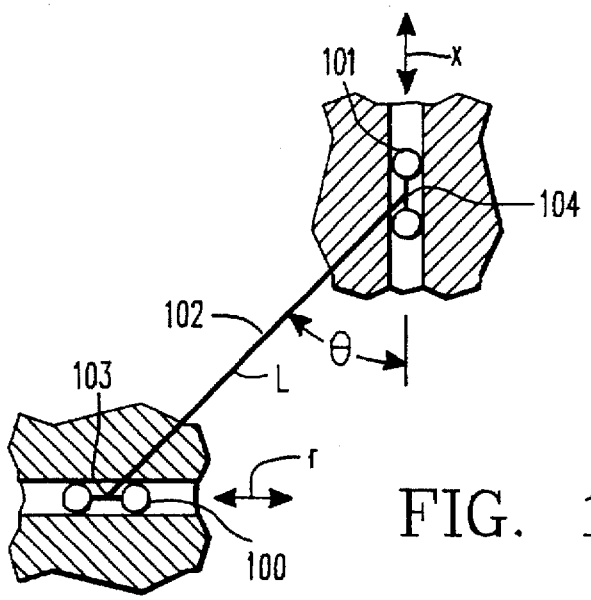
FIG. 14 serves to illustrate the concept of a mechanical transformation ratio.

As seen in FIG. 14, device 100 is constrained for movement along the r direction and device 101 is constrained for movement along the X directional orthogonal to the r direction. The two devices 100 and 101 are joined by a rigid line 102 connected at either end to respective pivot points 103 and 104. Device 100 is analogous to the driver and coupling sections 41 and 46, device 101 is analogous to piston member 38 and line 102 represents a rigid lever arm 45, with points 103 and 104 representing the hinged connection thereof to the coupling section 46 and piston member 38 respectively.

Line 102 is illustrated at an angle $\theta$ with respect to the x direction. Any radial movement of the driver section results in a corresponding axial movement of the piston member. The change in velocity in the x direction is related to the change in velocity in the r direction as brought out in the following equation.

$$\frac{dV_x}{dV_r} = \text{Tan}\,\theta \tag{6}$$

In actual operation, the displacements are small and for small displacements about a static angle $\theta_o$, the mechanical transformation ratio $\phi_m$ is the reciprocal of Tan $\theta$; that is, for small displacements:

$$\phi_m = \frac{1}{\text{Tan}\,\theta_o} \tag{7}$$

Figure 15:
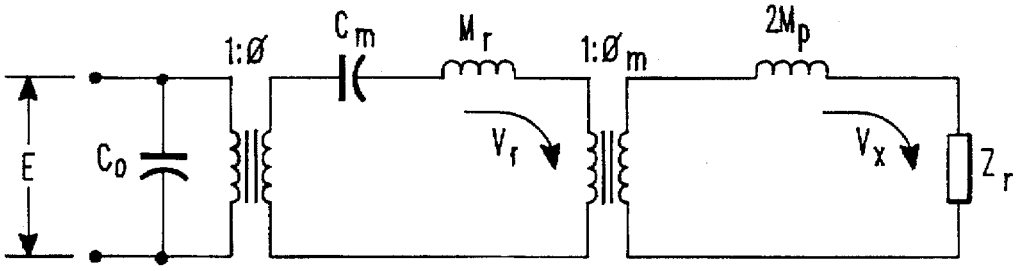
FIG. 15 is the electrical analog of the transducer described in FIGS. 6 to 13.

FIG. 15 approximates the electrical analog of the improved piston transducer of the present invention. In the electrical analog of FIG. 15, $2M_p$ represents the mass of two piston members 38 and 38'; $M_r$ the mass of the ring of piezoceramic elements 42 and coupling section 46 and $C_m$ their effective mechanical compliance; $C_o$ the blocked electrical capacitance; $\phi$ the electromechanical transformation ratio; $\phi_m$ the mechanical transformation ratio derived from FIG. 14; and $2Z_r$ the acoustical radiation resistance. $Z_r$ represents the radiation impedance seen by one piston. Current $V_r$ represents the velocity of the ring in the radial direction and current $V_x$ represents the velocity of the pistons in the axial direction, with the ratio of these currents, and therefore velocities being controllable by proper selection of angle $\theta_o$; that is, by operation of the transformer, $V_r:V_x=1:\phi_m$. For the electrical analogy of FIG. 15, it is assumed that the piston members, which may be made of steel, are of much greater mass than the lever arms, which may be made of aluminum. In such instance, the mass of the lever arms have been neglected in the electrical analog.

When the transducer is used in an array, the acoustical radiation impedance $Z_r$ may be replaced, as before, with the radiation resistance $R_r$ and with such substitution the transmitting voltage response TVR calculated from the equivalent circuit is as set forth in equation (8).

$$TVR\ \alpha\ \frac{V}{E} = \phi\phi_m\left[\frac{2R_r\omega^2 - j\omega(2M_p + \phi_m^2M_r)(\omega^2 - \omega_m^2)}{(2R_r)^2\omega^2 + (2M_p + \phi_m^2M_r)^2(\omega^2 - \omega_m^2)^2}\right] \tag{8}$$

Assuming that $2M_p >> \phi^2M_r$, the resonant frequency $\omega_m$ and acoustical quality factor $Q_a$ may be calculated as follows:

$$\omega_m = [C_m(M_r + 2M_p/\phi_m^2)]^{-1/2} \approx \phi_m(2C_mM_p)^{-1/2} \quad (9)$$

$$Q_c = \frac{\omega_m(2M_p + \phi_m^2 M_r)}{2R_r} \approx \frac{\omega_m M_p}{R_r} \quad (10)$$

In comparison with the prior art ring transducer of FIG. 3, the resonant frequency $\omega_m$ of the present invention is a function of the mechanical transformation ratio $\phi_m$. Further, the mass controlling this resonance is not dependent upon the mass of the piezoceramic material as in the prior art ring transducer.

With the arrangement of the present invention, the radial motion of the driver section 41 is transferred to axial motion of the piston members 38, 38'. The lever arms provide the mechanical transformation ratio which amplifies the piston mass to achieve a lower resonant frequency for a given size than previously available in Tonpilz type transducers. The rigid lever arms in conjunction with their hinged connections insure that the lever arms move with uniform angular velocity relative to either hinge pivot axis. Thus, ideally, there is no elastic strain energy degradation as in a flex-tensional shell the surface of which is designed to provide non-uniform angular velocity by its manner of flexing.

Figure 16:
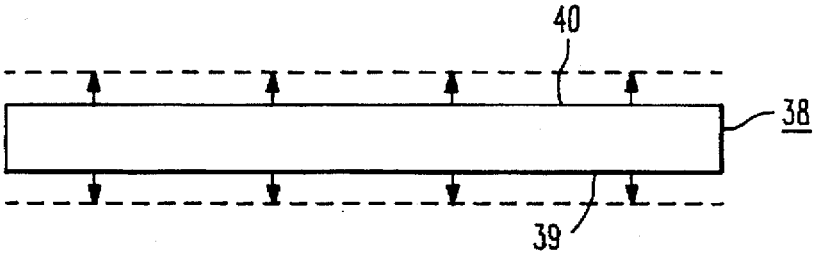
FIG. 16 serves to illustrate the movement of the radiating face of the transducer.

Further, as illustrated in FIG. 16, the coupling arrangement is such that the piston member 38 experiences positive and negative excursions between the dotted limits (shown exaggerated) such that the radiating surface 39 of piston member 38 moves with a uniform velocity distribution. That is, for the piston illustrated, for any excursion, the surface of the piston is parallel to the surface at its rest position as in a typical Tonpilz transducer and as opposed to a flex-tensional type transducer wherein the surface movement is non-uniform and extremely complex.

The transducer thus far described radiates from both piston members 38 and 38' and as such, is a double piston transducer. Any hydrostatic pressure applied to either piston serves to increase the static preload on the ring of piezoceramic elements. If one of the two piston members is shielded from the fluid medium, one sided radiation may be achieved thus reducing the radiation load by a factor of 2. One way of accomplishing this one sided radiation is illustrated in FIG. 17.

Figure 17:
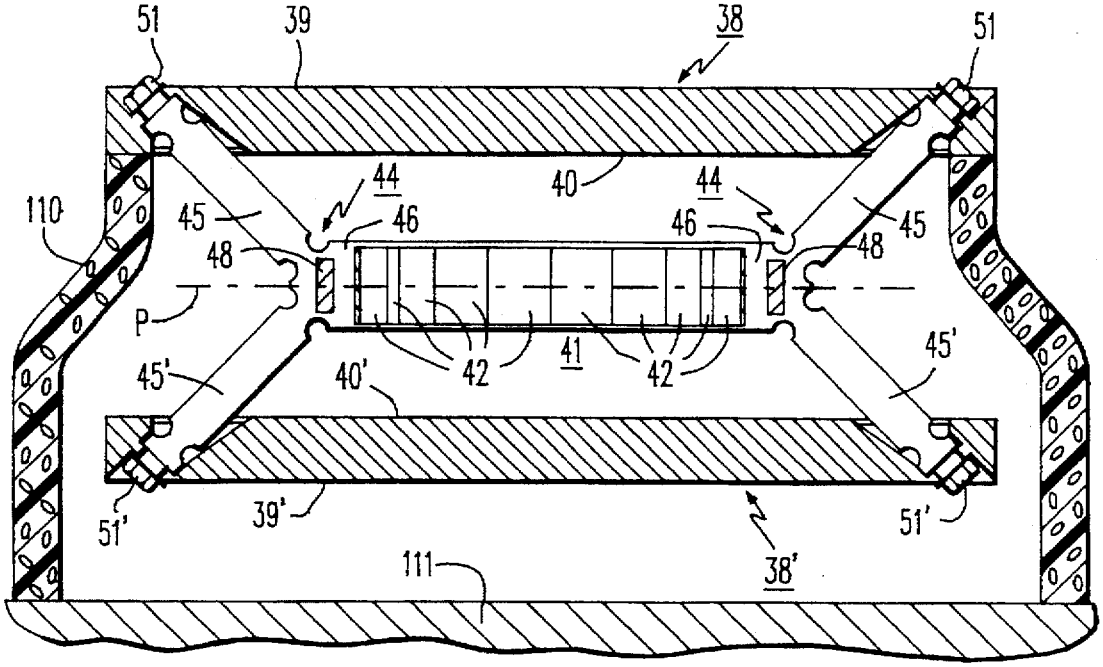
FIG. 17 illustrates the transducer with one-sided radiation.

FIG. 17 illustrates the transducer previously described, with the addition of a support member 110 which surrounds the transducer and contacts the rear surface 40 of piston member 38. At its other end, the cylindrical support 110 contacts a rigid backing 111. It is thus seen that piston member 38' is not exposed to the ambient fluid medium and proper operation of the transducer may be accomplished with a support member which is statically rigid to withstand the ambient pressure but is dynamically flexible to allow movement of piston member 38 at the operating frequency.

Figure 18:
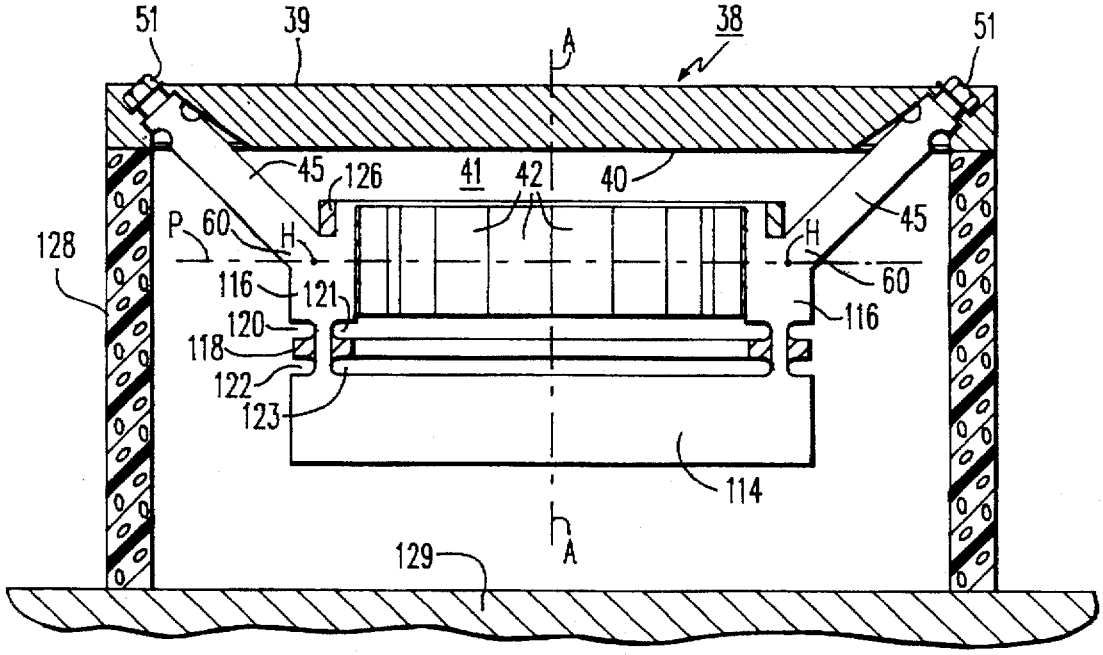
FIG. 18 illustrates an alternate embodiment of the transducer.

Another example of single sided radiation is illustrated in FIG. 18 wherein the transducer includes only a single radiating piston member 38 with the other piston member being used as an inertial mass 114. The ring of piezoceramic elements 42 is constrained by means of a coupling section 116 to which the inertial mass 114 is coupled by means of a connection 118 having grooves 120 to 123 such that free movement is allowed in the radial direction while maintaining a rigid connection between the coupling section 116 and inertial mass 114 in the longitudinal direction.

Lever arms 45 connect the piston member 38 with the coupling section 116 and in order to reduce the bending moment created by unbalanced radial forces, the hinge axis of hinge 60 at the first end of lever arm 45 is moved as close to the mid-plane P as is possible.

A preload ring 126 completes the assembly and is placed to encircle the upper portion of the ring of piezoceramic elements 42. This preload section 126 is somewhat reduced in stiffness in order to balance out the radial stiffness and moment generated by the connection 118 supporting the inertial mass 114.

For one-sided radiation, the transducer is provided with a cylindrical support 128 similar to support 110 of FIG. 17, and connected to rigid backing 129.

Figure 20:
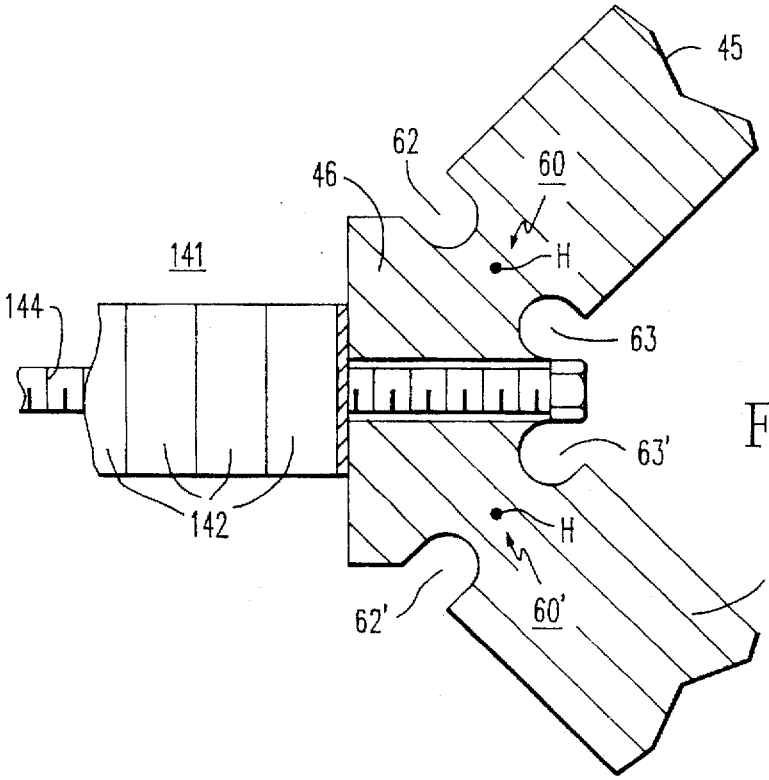
FIGS. 19 and 20 illustrate an alternate transducer driver section driving the transducer.
Figure 19:
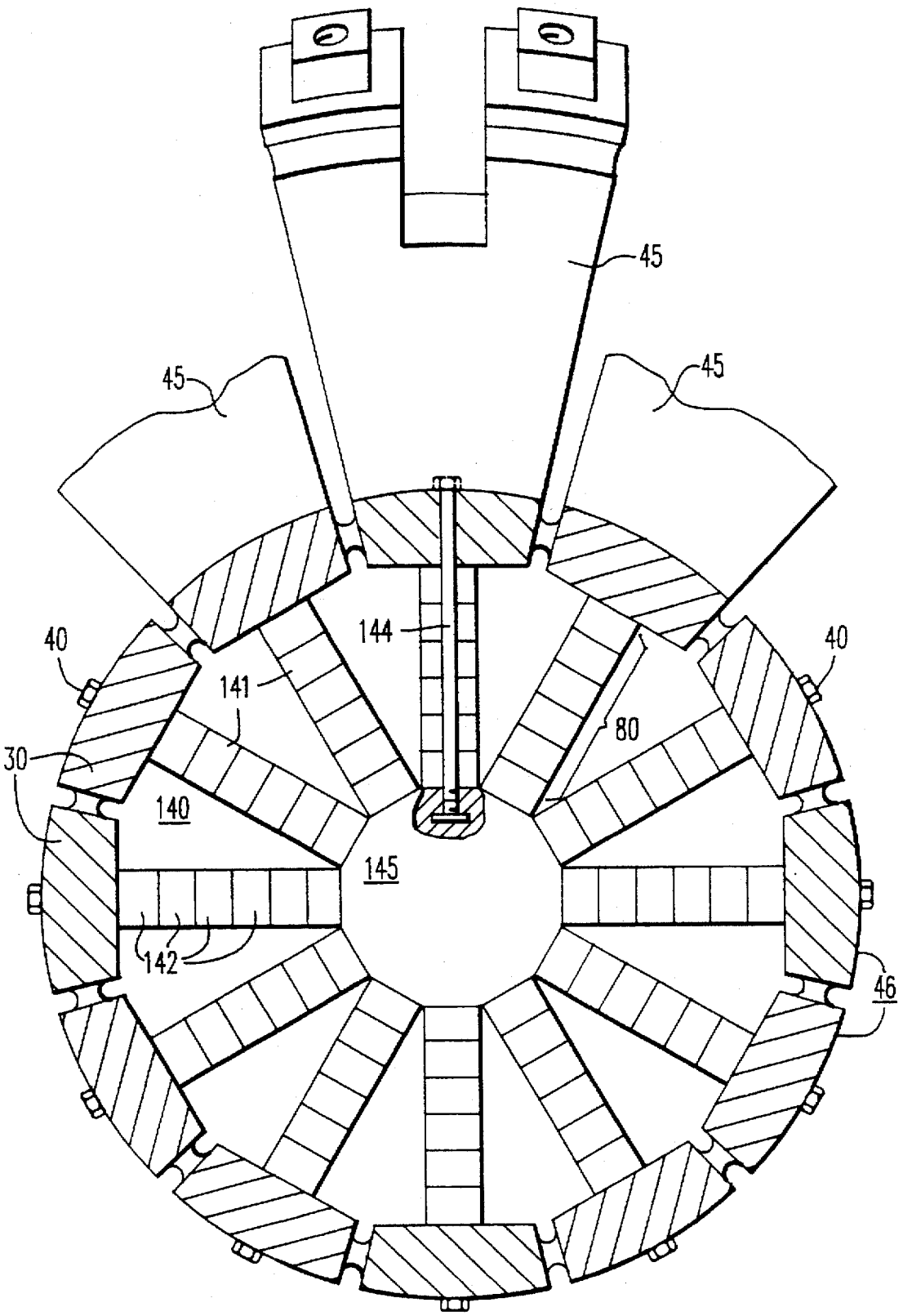

FIGS. 19 and 20 illustrate another embodiment of the present invention utilizing a different driver means. The simplified plan view presentation illustrated in FIG. 19 includes the coupling section 46 in cross section and to which the lever arms 45 are connected. The driver section 140 includes a plurality of radially-extending longitudinally-active bars 141 which may be single magnetostrictive or piezoceramic units, or as illustrated, by way of example, may be comprised of a plurality of small cylindrical rings 142 of piezoceramic material. A stress bolt 144 serving the preloading function, extends through a radial aperture in rings 142 and is connected to a central block 145 (FIG. 19). Operation of the transducer is similar to that previously described in that collective longitudinal movement of the bars 141 of driver section 140 produces a radial movement of coupling section 46 and a corresponding axial movement of the lever arms 45 and the piston member (or members if two-sided radiation is desired) which would be connected to the lever arms.

Figure 21:
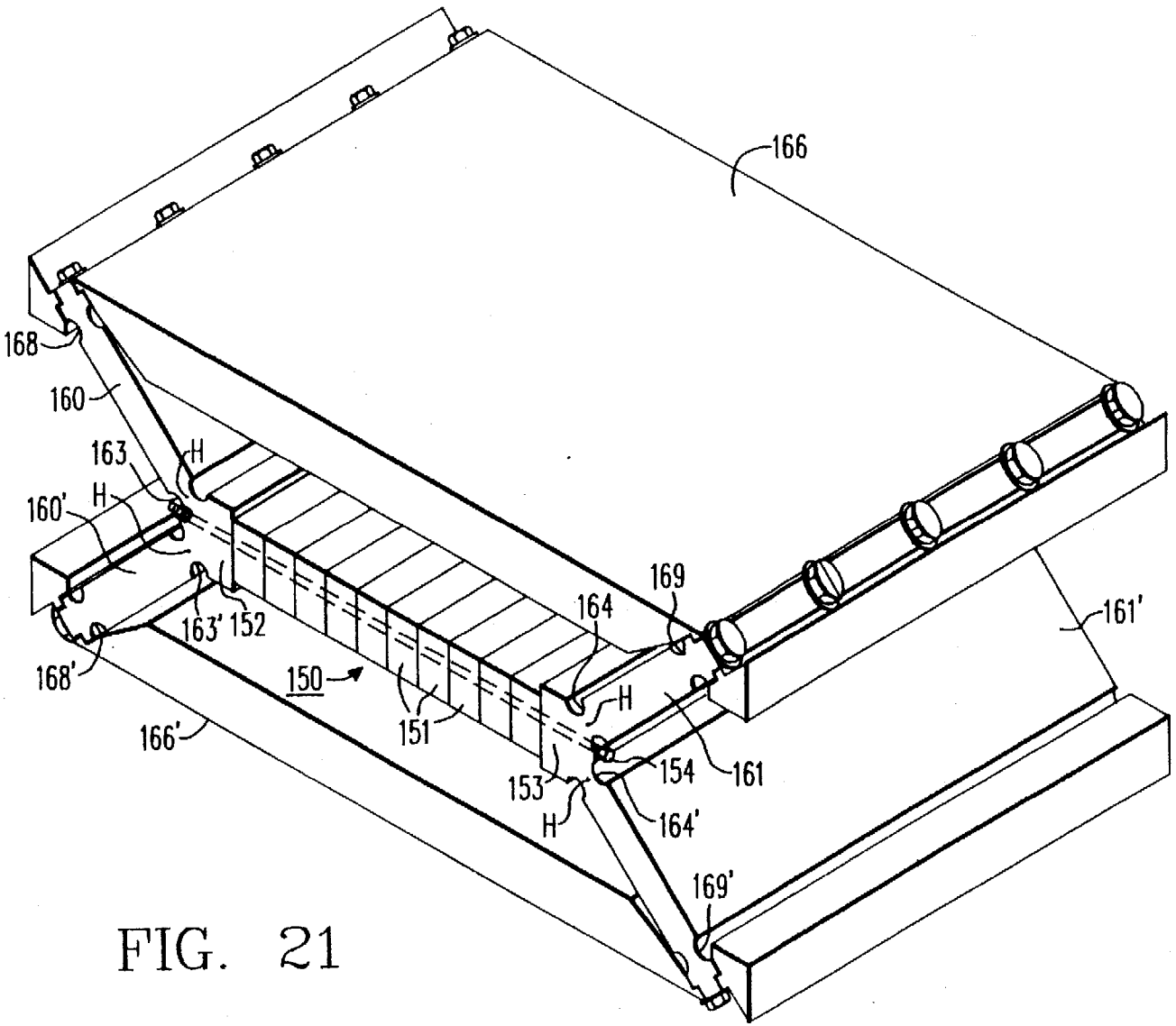
FIGS. 21 and 22 illustrate yet another embodiment of the present invention.
Figure 22:
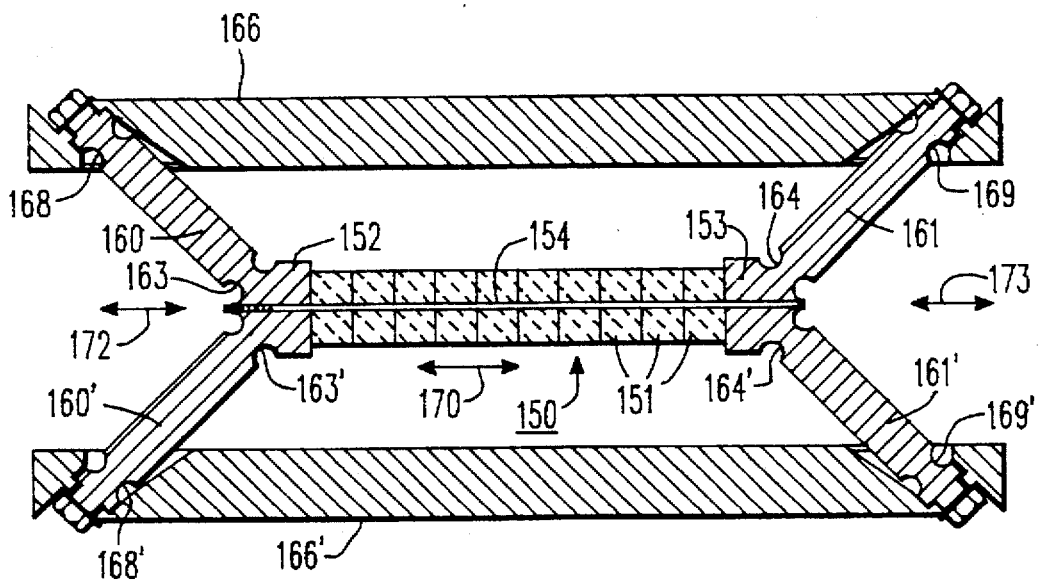

FIGS. 21 and 22 illustrate respectively a perspective view and a side view in section of another embodiment of the present invention. For the embodiment illustrated, the driver section 150 is comprised of a plurality of stacked magnetostrictive or piezoceramic elements 151 which extend between elongated coupling section 152 and 153 and held in position by means of one or more stress bolts 154.

First and second lever arm sections are provided and in one embodiment are illustrated as single lever arms 160 and 161. The lever arms are connected at a first end to respective coupling sections 152 and 153 by means of first hinge means 163 and 164 and are connected at their second ends to piston member 166 via second hinge means 168 and 169. Expansion and contraction of the driver section 150 is not radial as in the prior cases but instead is confined to rectilinear movement as indicated by arrow 170. The coupling section is comprised of a first elongate portion 152 connected to one end of driver section 150, and a second elongated portion connected to the other end of driver section 150. The lateral movement of the driver section 150 results in a corresponding lateral movement of the elongated coupling sections 152 and 153 in the directions as indicated by arrows 172 and 173. With the provision of hinged lever arms 160 and 161, this lateral movement is translated into a corresponding axial movement of the piston member 166.

For two-sided radiation, a second set of lever arms sections 160' and 161' is provided along with a second piston member 166'.

Although the invention has been described with a certain degree of particularity, it is obvious that modifications of the invention described by way of example may be made by those skilled in the art.

I claim:

1. A transducer having a longitudinal axis, comprising:

a) at least one rigid, non-flexural piston mass member having a front radiating surface and a rear surface;

b) electromechanically active driver means exhibiting expansion and contraction in a plane perpendicular to said longitudinal axis;

c) said driver means and said position mass member being spaced from one another along said longitudinal axis;

d) connecting means including i) at least two lever arms having first and second ends, and ii) a coupling section, said connecting means coupling said driver means with said piston mass member and operable to translate movement of said driver means in said plane into a corresponding axial movement of said piston mass member;

e) said coupling section being disposed between said driver means and said first ends of said lever arms;

f) first hinge means for each said lever arm, having a pivot axis and connecting a first end of a respective lever arm to said coupling section;

g) second hinge means for each said lever arm, having a pivot axis and connecting a second end of a respective lever arm to said piston mass member;

h) said lever arms having a rigidity, and said hinge means being constructed and arranged such that during operation, said lever arms move with a uniform angular velocity about said pivot axis of either of said hinge means, and said radiating surface of said piston mass member moves with a uniform velocity distribution.

2. Apparatus according to claim 1 which includes:

a) a second piston mass member axially displaced from said driver means;

b) additional ones of said lever arms hingedly connected between said coupling section and said second piston mass member;

c) said piston mass members being on opposite sides of said plane.

3. Apparatus according to claim 1 wherein:

a) said driver means is annular and is operative in a hoop mode of operation; and b) said connecting means is operable to translate radial movement of said annular driver means into a corresponding axial movement of said piston mass member.

4. Apparatus according to claim 3 wherein:

a) said piston mass member is circular.

5. Apparatus according to claim 4 wherein:

a) said radiating surface is planar.

6. Apparatus according to claim 3 wherein:

a) said driver means is a piezoceramic ring; and b) said coupling section is a circumferential restraining ring surrounding said piezoceramic ring and operable to apply a preload stress to said piezoceramic ring.

7. Apparatus according to claim 6 wherein:

a) said second end of each said lever arm is bifurcated.

8. Apparatus according to claim 7 which includes:

a) each branch of said bifurcated end of said lever arm includes a hinge means.

9. Apparatus according to claim 6 wherein:

a) said restraining ring includes alternate sections of reduced volume to reduce the stiffness of said restraining ring while still maintaining said preload stress on said piezoceramic ring.

10. Apparatus according to claim 6 wherein:

a) said piezoceramic ring is comprised of a plurality of piezoceramic driver elements each including a flat outer surface;

b) said restraining ring includes a faceted inner surface, with the number of facets matching the number of said driver elements; and c) the flat outer surface of each said driver element being contiguous a respective one of said facets.

11. Apparatus according to claim 10 which includes:

a) a shim element interposed between the flat outer surface of each said driver element and the facet to which it is contiguous;

b) said shim element being operable to prevent stress concentrations in said driver element.

12. Apparatus according to claim 6 wherein:

a) said lever arms are integral with said restraining ring.

13. Apparatus according to claim 1 which includes:

a) a backing;

b) a support member extending between and contacting said rear surface of said piston mass member and said backing;

c) said support member being rigid in response to external static forces and flexible in response to dynamic forces.

14. A transducer having a longitudinal axis, comprising:

a) a rigid non-flexural piston mass member having a front radiating surface and a rear surface;

b) electromechanically active driver means exhibiting expansion and contraction in a plane perpendicular to said longitudinal axis, said plane bisecting said driver means;

c) said driver means and said piston mass member being spaced from one another along said longitudinal axis;

d) connecting means coupling said driver means with said piston mass member and operable to translate movement of said driver means in said plane into a corresponding axial movement of said piston mass member;

e) said connecting means being constructed and arranged such that during said axial movement of said piston mass member, said radiating surface moves with a uniform velocity distribution;

f) an inertial mass member connected to said connecting means;

g) said piston mass member and inertial mass member being on opposite sides of said plane.

15. Apparatus according to claim 14 wherein:

a) said driver means is an annular arrangement of piezoceramic elements operative in a hoop mode of operation;

b) said connecting means includes i) a coupling section surrounding said elements and ii) a plurality of lever arms each having a first and second end;

c) the first end of each said lever arm being connected to said coupling section;

d) the second end of each said lever arm being connected to said piston mass member.

16. Apparatus according to claim 15 wherein:

a) each said lever arm is connected to said coupling section at the position where it is intersected by said plane.

17. Apparatus according to claim 16 which includes:

a) hinge means located at both said ends of said lever arm to allow relative angular movement of said lever arm with said coupling section at one end and said piston mass member at the other end.

18. Apparatus according to claim 17 which includes:

a) a backing;

b) a support member extending between and contacting said rear surface of said piston mass member and said backing;

c) said support member being rigid in response to external static forces and flexible in response to dynamic forces.

19. Apparatus according to claim 1 wherein:

a) said coupling section is in the form of a ring;

b) said driver means is comprised of a plurality of individual longitudinally active members radially arranged within said ring.

20. Apparatus according to claim 19 wherein:

a) each said active member is formed by a stack of short cylinders of piezoceramic material; and which includes b) a block member centrally located within said ring section; and c) a stress bolt extending through said stack of cylinders and connected at one end to said ring and at the other end to said centrally located block member.

21. Apparatus according to claim 19 which includes:

a) a second piston mass member axially displaced from said driver means;

b) additional ones of said lever arms hingedly connected between said coupling section and second piston mass member;

c) said piston mass members being on opposite sides of said plane.

22. Apparatus according to claim 1 wherein:

a) said driver means is constructed and arranged to exhibit expansion only in one direction and contraction in an opposite direction in said plane, said expansion and contraction being rectilinear.

23. Apparatus according to claim 22 wherein:

a) said driver means includes first and second ends;

b) said connecting means includes first and second lever arm sections and said coupling section includes first and second separated portions each connected to a respective end of said driver means;

c) said first lever arm section being hingedly connected to said first portion of said coupling section and said piston mass member;

d) said second lever arm section being hingedly connected to said second portion of said coupling section and said piston mass member.

24. Apparatus according to claim 23 wherein:

a) said piston mass member is rectangular.

25. Apparatus according to claim 23 wherein:

a) said first and second lever arm sections are each comprised of a single lever arm.

26. Apparatus according to claim 22 which includes:

a) a second piston mass member axially displaced from said driver means;

b) additional ones of said lever arm sections hingedly connected between said halves of said coupling section and said second piston mass member;

c) said piston mass members being on opposite sides of said plane.

* * * * *